US010780407B2

(12) United States Patent
Supan

(10) Patent No.: US 10,780,407 B2
(45) Date of Patent: Sep. 22, 2020

(54) METHOD AND SHAKER FOR MIXING LIQUIDS

(71) Applicant: Carlota Supan, Izola (SI)

(72) Inventor: Carlota Supan, Izola (SI)

( * ) Notice: Subject to any disclaimer, the term of this patent is extended or adjusted under 35 U.S.C. 154(b) by 227 days.

(21) Appl. No.: 16/075,721

(22) PCT Filed: Feb. 8, 2016

(86) PCT No.: PCT/IB2016/050651
§ 371 (c)(1),
(2) Date: Aug. 6, 2018

(87) PCT Pub. No.: WO2017/137799
PCT Pub. Date: Aug. 17, 2017

(65) Prior Publication Data
US 2019/0046937 A1 Feb. 14, 2019

(51) Int. Cl.
*B01F 13/00* (2006.01)
*A47K 5/12* (2006.01)
(Continued)

(52) U.S. Cl.
CPC ..... *B01F 13/0052* (2013.01); *A47K 5/1201* (2013.01); *B01F 3/08* (2013.01);
(Continued)

(58) Field of Classification Search
CPC ..... A47K 5/1201; B01F 13/0052; B01F 15/00512; B01F 15/00857; B01F 15/0225;
(Continued)

(56) References Cited

U.S. PATENT DOCUMENTS 1,910,900 A * 5/1933 Johnson ..... D06F 5/005 68/213
1,967,469 A * 7/1934 Hughes ..... A47J 43/27 220/568
(Continued)

FOREIGN PATENT DOCUMENTS

DE 202008000803 U1 11/2008
DE 202011100682 U1 7/2011

*Primary Examiner* — Tony G Soohoo
(74) *Attorney, Agent, or Firm* — Ziolkowski Patent Solutions Group, SC

(57) ABSTRACT

To sum up, by using the shaker for mixing liquids (1-7) (e.g. shampoo, soap, etc) with water right before use, an optimal dose of the liquid is used and appropriate solution is used. A dissolved mixture is applied to the hair/body to most significant part immediately—the hair roots and the scalp. It works beneficial for the hair, especially the hair ends, preventing dry and split ends as the e.g. shampoo is not applied directly. The mixture is distributed more evenly throughout the hair, without adding additional water and washing out the unused shampoo. The foam evolves quicker and is greater, which makes the washing easier. The shaker enables the user to use multiple liquids at once if needed. The amount of the liquid used is decreased to an optimal dose for the user and is therefore also eco-friendly, as no excessive amount of liquid is used. The invention enables the user to close tap water/shower during use and therefore uses less water and is eco-friendly. With same advantages the shaker is used in pet care and with other liquids.

13 Claims, 1 Drawing Sheet

(51) Int. Cl.
*B01F 15/00* (2006.01)
*B01F 15/02* (2006.01)
*B01F 3/08* (2006.01)
*B01F 15/04* (2006.01)

(52) U.S. Cl.
CPC ..... *B01F 3/0803* (2013.01); *B01F 15/00512* (2013.01); *B01F 15/00857* (2013.01); *B01F 15/0225* (2013.01); *B01F 15/0462* (2013.01); *B01F 2215/0031* (2013.01)

(58) Field of Classification Search
CPC ..... B01F 15/0462; B01F 2215/0031; B01F 3/08; B01F 3/0803
USPC ..... 366/129–130, 336–340
See application file for complete search history.

(56) References Cited

U.S. PATENT DOCUMENTS 2,784,949 A * 3/1957 Dennon ..... B01F 15/0225 366/130
4,702,270 A * 10/1987 King, Sr. ..... B01F 1/0027 137/268
4,763,685 A * 8/1988 King, Sr. ..... B01F 1/00 137/268
4,906,103 A * 3/1990 Kao ..... A61J 1/2089 141/313
4,928,857 A * 5/1990 Ecker ..... A47K 5/122 222/190
5,358,330 A * 10/1994 Moll ..... B01F 5/0683 206/221
5,387,034 A * 2/1995 Bauer ..... B05B 11/3084 222/145.5
5,547,275 A * 8/1996 Lillelund ..... A47J 43/27 366/130
RE36,554 E * 2/2000 Chedville ..... A47J 43/04 118/13
6,450,366 B1 9/2002 de Laforcade
9,855,571 B2 * 1/2018 Camilleri ..... B01F 15/00512
2008/0179334 A1 * 7/2008 Abramson ..... B01F 15/00512 220/568
2010/0202246 A1 * 8/2010 Huck ..... B01F 13/0052 366/185
2014/0119154 A1 * 5/2014 Kershaw ..... B01F 3/08 366/130
2016/0184785 A9 * 6/2016 Kershaw ..... A47G 21/18 366/130
2016/0270601 A1 * 9/2016 Hellmann ..... B01F 15/00512
2016/0280446 A1 9/2016 Casey
2019/0046937 A1 * 2/2019 Supan ..... B01F 15/0462
2019/0116954 A1 * 4/2019 Gayton ..... A45D 19/02
2019/0366283 A1 * 12/2019 Buckley ..... B01F 13/002

* cited by examiner

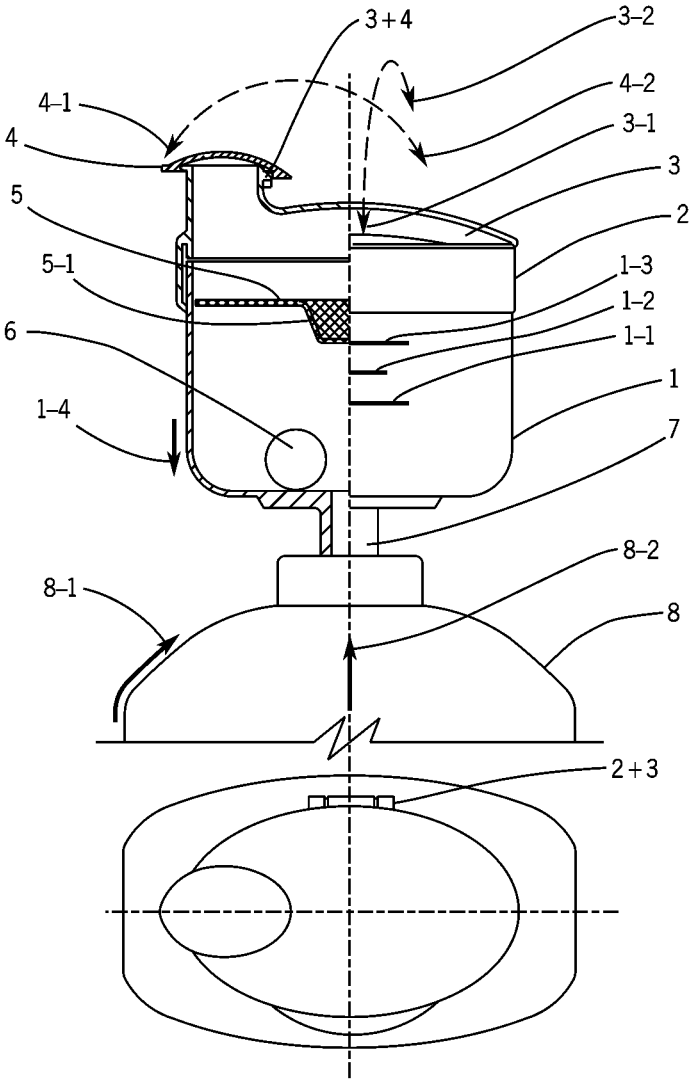
3+4
3-2
4-2
4-1
3-1
4
3
5
2
5-1
1-3
1-2
6
1-1
1
1-4
7
8-2
8-1
8
2+3

METHOD AND SHAKER FOR MIXING LIQUIDS

DESCRIPTION OF THE INVENTION

Mode of Use

The invention shall be used in the field:
hair washing
body washing/showering
pet bathing . . .
by mixing liquid (e.g.: shampoo, liquid soap, etc.) with water right before use.

OPP: the term liquid and fluid are used as interchangeable terms and are general terms used for washing liquid, shampoo, liquid soap and other liquids or fluids that might be used

SHORT DESCRIPTION

Liquid & water shaker/Friendly-healthy shaker

The Problem that the Invention is Solving

Up until now, the user applied concentrated shampoo directly on the hair or on the hands and then on the hair. The shampoo is not dissolved in water, the water is added afterwards. The same goes for showering with liquid soap and pet bathing.

Like this, the user is applying shampoo on the top of the hair and the hair ends, which is causing the hair to be dry and dull and the ends to split.

Only after rubbing the shampoo into the hair, it reaches the scalp, removing grease, which is the main purpose of hair wash. By putting the shampoo directly on the hair, the shampoo is distributed unevenly on the hair and can cause irritation, dandruff, dryness, split ends, inflammation . . . . In the aim of distributing the shampoo more evenly and to achieve better foaming, the user usually adds water. By this, the user is washing off huge part of unused shampoo, subsequently using more shampoo than necessary. Nonetheless, if two or more various shampoos for different hair types and with different features are used, the user must repeat the hair wash from the start for each shampoo.

TYPES OF THE INVENTION

TYPE "A": Shaker with push dose, installed on the original package of the liquid:
by the number of pushes the user reaches optimal dose for washing it's hair,
which is designated by the length, age (adult/child), how "dirty" the hair is, etc.

TYPE "B": Stand-alone shaker, where the dose of the shampoo if fully up to the user (guideline doses are given) and is not attached to original package of the liquid (shampoo, etc.).

Benefits

With the invention (mixing of water with shampoo in the mixing retainer right before use and controlled dose of shampoo with installed pump dose and measure for additional shampoo and the mark for maximum volume of mixture in the mixing retainer) the mixture of shampoo and water, reaches the scalp immediately, washing out grease from the hair, without drying it out or causing damage to the hair ends. The mixture is diluted and easily poured onto the hair and the scalp. The mixture is less diluted, less aggressive and it decreases the odds of dandruff and allergies rapidly.

The mixture is also easily distributed throughout the hair without adding water from the shower, which rinses unused shampoo from the hair. The mixture penetrates to the scalp and does not remain solely on the hair ends and top of the hair and therefore prevents split ends.

With having a mixture at hand, we immediately start with hair wash, without adding additional water from the shower. Therefore the hair was is better, the shampoo foams better, it is beneficial for the hair and the put-out of the shampoo is optimal, as we use less shampoo for better results, as none gets washed out unused and is therefore eco-friendly. Moreover, various types of shampoos and/or essential oils can be used at once (e.g.: anti dandruff and for shiny hair). The benefits apply for all other liquids as well.

BRIEF DESCRIPTION OF THE DRAWINGS

FIG. 1 is a side view of a shaker useable with a package of liquid, according to an embodiment of the invention.

TYPES OF INVENTION AND DESCRIPTION

TYPE "A" consists of:

Lower part of the shaker bowl (1) is made of see-through plastic (in order to see the level of the mixture from the outside). The volume is cca.100 ml. On the outer part of the shaker there are marks for maximum level of the content (1-3): 60 ml (marking maximum level of the mixture of water and the liquid (1-3), including the volume of the mixing item (6)) and additional marks at 30 ml (1-1) and 45 ml (1-2).

Position of the mark on the mixing retainer (1-4) regarding the mark on the original package of the liquid (8-1 and 8-2) determines the function:

Position 8-1: closed/blocked: in this position the user adds: additional liquid through perforated measure(s) (5-1), adds water, shakes the mixture and pours the mixture through the cover (3) or smaller effusion (4). Both covers (3 and 4) can be opened in this position.

Position 8-2: open: adding of the liquid with a push dose (7): the mixing retainer is turned 90 degrees anticlockwise according to the position 8-1.

When the marker of shaker (1-4) is aligned with the position (8-1) on the liquid bottle, the shaker is blocked, liquid and water already added and the mixture is ready for shaking. The block position disables the user from accidentally adding a new dose of the liquid. With having a pump dose, it is prevented for the water to get into the liquid bottle as it only remains in the shaker. Water is added in this position.

Position (8-2) is for adding the liquid. The shaker is turned 90 degrees anticlockwise regarding the original package and adding of the liquid is possible.

In the upper part of mixing retainer (1) there is a perforated net (5) with 1-3 recessed perforated measures of 5 ml (5-1) for adding $2^{nd}$, $3^{rd}$ liquid with different features (anti dandruff, volume shampoo, for greasy hair . . . ).

In the closed compartment of the lower shaker bowl under the perforated net (5), a non-corrosive and heavy enough to drop to the floor, mixing item (6) of ϕcca. 8-10 mm is added for enhanced mixing properties. Alternatively, a wire ball (6) of ϕ. cca 10-13 mm can be inserted. The latter is hollow for better mixing properties. The perforated net (5) is also used to prevent the balls from falling out of the shaker.

The bottom part of the mixing retainer (1) is inserted directly to the original package of the liquid (8) with a pump-dose (7). With one push, 5 ml of liquid is added in the shaker. Many doses can be added, but the maximum of the mixture of 60 ml (1-3) must be observed. Nevertheless, the maximum can be observed in two manners: from the outside with the max. mark (1-3) or by opening the lid. When the mixture reaches the recessed part of the perforated net (5-1), maximum is reached.

The quantity of the mixture depends on:

- thickness of the liquid (thicker e.g. shampoo requires more water)
- how dirty the hair is (dirtier require more e.g. shampoo and more water)
- optimal balance is set by the user, guidelines are given by the producer.

Upper part of the shaker bowl (3) comprises of: lid base (2), the lid (3) and smaller effusion with lid (4)

The lid (3) is attached to the lid base (2) by a joint (2+3). The lid (3) is used to add $2^{nd}$ or $3^{rd}$ liquid (optional) and to add water. In order to make opening and closing easier, the lid has a tiny handle, as it is usually slippery and wet when used. The positions open and closed mare marked as 3-2 and 3-1. When the lid (3) is closed, it snaps to the tiny hook in the lid base (2). The edge between the cover is made in manner to make the shaker waterproof when the lid (3) is closed and during shaking to prevent the mixture from dripping.

The lid (3) has a pin to keep the lid open when opened (3-2).

In the lid there is also a smaller effusion of 1 cca 13 mm, with its own smaller lid (4) attached by joint to the effusion. The smaller lid (4) is opened while pouring the mixture onto the hair (open: 4-2, closed: 4-1).

There is a 10 mm space between the upper level of the lid base (2) and the perforated net (5) in order to diminish spraying of the water when it is added and enabling the mixture to combine better.

Type"B": Stand-alone Shaker

The mixing retainer (1) is detached/not attached to any original dose of liquid. Liquid and water are added through the cover (3).

Dose is indicated with the measure (5-1) in the perforated net. The net has 3 measures of 5 ml (3×5 ml=15 ml), in which the liquid is measured.

Shaker is made the same as type "A", but it has no pump dose. Shaker needs to have a good hand grip, as it is usually wet and slippery when used.

All other technical specifications and the mode of use are the same as in type "A".

How it Works:

TYPE "A": Shaker attached directly to the pump dose and the latter installed onto original package of the liquid:

Type A has two positions: locked (8-1) and open (8-2), which are marked on the original dose of the liquid (e.g. shampoo).

The user should hold the original package of the liquid (8) in one hand and turn the mixing retainer (1) horizontally around its vertical axis 90 degrees anticlockwise from position 8-1 (position 8-1: closed, adding of the liquid through perforated measure (5-1), adding water, shaking/mixing, pouring of the mixture) marked on the original package of the liquid to position 8-2 (position 8-2: open, pump dose enabled) in order to use it.

Various amounts of liquid can be added to the shaker by one or multiple vertical pushes down, each adding 5 ml.

1-2 doses for babies and children: cca 5-10 ml
3 doses for short hair: cca 15 ml
4 doses for mid length hair: cca 20 ml
5 doses for longer hair: cca 25 ml

***15 ml is the average volume of walnut, which is a recommended volume of shampoo for one hair wash of mid-length hair.

When done, the mixing retainer (1) is turned back to the position 8-1 on the original package (it is turned 90 degrees clockwise around its vertical axis). The lid is opened (3) (from position 3-1 to position 3-2) and another liquid can be added in the perforated measure (5-1) in the perforated net (5). Additional measures of the liquid can be lightly washed out by adding small amount of water. When done, water is added to preferred level (1-1, 1-2, 1-3), up to maximum level of 1-3, marked on the outside of the mixing retainer. Maximum level of water and the liquid can also be observed with lid opened (3-2). Maximum level of mixture is reached, when it touches the bottom of the perforated measure (5-1) in perforated net (5).

If too much water is added, it can simply be poured out before mixing or another dose of the liquid added.

When done, the cover (3) is closed to 3-1 position and the mixture is shook 3-5 times, so that it mixes well. The sound of mixing items (6) that enhance efficiency and quality of mixing is heard when it is shook.

Once done and water and the other liquid are well combined and implicated, a smaller cover (4) is opened from position (4-1) to position (4-2) and the mixture is evenly applied to wet hair. The user begins with hair wash immediately, without adding water from the shower TYPE "B": The cover (3) is opened (3-2) and desired amount of liquid added through perforated measures (5-1) in the perforated net (5). A few different liquids can be added at this point. When done, water is added through the same cover up to the maximum mark on the shaker (1-3) or maximum to the bottom of perforated net (5-1) if observed through the cover. The cover is closed (3-1) and mixture shook 3-5 times (or more). When done, smaller cover (4) is opened and the mixture poured.

OPP: In both types more than one liquid can be used at the same time and then water added, all liquids mixed at the same time and applied only once.

MAIN BENEFITS

- Liquid mixed with water is appropriately dissolved, reaching optimal viscosity and easier to apply, reaching the root of the hair and the scalp immediately, removing grease and evenly applied from the first stroke
- Since it is already mixed with water, it is less aggressive to the scalp (important esp. for children and people with allergies)
- As the mixture is not as thick as the liquid itself it is not left on the hair ends and is not drying them out.
- With pump dose or dose in the perforated net, the user always reaches optimum mixture for his/hers hair type and length
- The mixture is easier to apply evenly, without washing out unused liquid with water from the shower and the user can start with washing and rubbing immediately
- Greater "output" of the liquid
- Thorough and faster hair wash and greater foam
- Possibility of using various liquids in one single wash, without having to wash them out separately each time
- Using optimal dose of liquid which is eco-friendly (prevention from using too much unnecessary liquid)

Closing a tap/shower during hair/body wash is eco-friendly (the user uses less water)

The invention claimed is:

1. An apparatus suitable for mixing washing liquid with water right before use, the apparatus comprising:

a mixing retainer (1), a cover (3), a perforated net (5), mixing items (6), and a dose pump (7);

wherein the mixing retainer (1) is made of transparent plastic material, and has level marks (1-1,1-2,1-3) and a position mark (1-4) on an outer surface thereof;

wherein the cover (3) is attached to the mixing retainer (1) in a waterproof manner;

wherein a neck of the cover (3) is positioned eccentrically in relation to the center of the mixing retainer (1) and is closed with a cover (3+4);

wherein the perforated net (5) is positioned between the mixing retainer (1) and the cover (3) and comprises a plurality of recessed perforated measures of 5 ml each, for adding at least one dose of an additional liquid;

wherein the mixing items (6) have specific mass greater than the specific mass of the washing liquid; and wherein the mixing items (6) are solid having a diameter from 8 to 10 mm or are hollow, having a diameter from 10 to 13 mm, and are made of non-corrosive material.

2. The apparatus of claim 1, wherein the mixing retainer (1) is installed onto a dose pump (7); and wherein the dose pump (7) is fitted onto an original package (8) of the washing liquid.

3. The apparatus of claim 1 wherein the mixing items (6) comprise balls.

4. The apparatus of claim 1 wherein a lower part of the cover (3) comprises an effusion (4).

5. The apparatus of claim 1 wherein the perforated net (5) comprises a recessed perforated measure.

6. The procedure of mixing washing liquid right before use using the apparatus of claim 1, comprising of the following steps:

setting a desired dose of the washing liquid;

mixing the washing liquid with water.

7. The procedure of claim 6, wherein the desired dose of the washing liquid is set by the dose pump (7).

8. The procedure of claim 6 further comprising setting a desired dose of a second liquid.

9. The procedure of claim 8 further comprising mixing the second liquid with water.

10. The procedure of claim 8, wherein the desired dose of the second liquid is set by the measuring net (5-1).

11. The procedure of claim 8 further comprising setting a desired dose of a third liquid.

12. The procedure of claim 11 further comprising mixing the third liquid with water.

13. The procedure of claim 11, wherein the desired dose of the third liquid is set by the measuring net (5-1).

* * * * *